United States Patent [19]

Knapp et al.

[11] Patent Number: 4,879,496

[45] Date of Patent: Nov. 7, 1989

[54] DISPLAY TUBE

[75] Inventors: Alan G. Knapp, Crawley; Daphne L. Lamport, Caterham; Derek Washington, Wallington; Alfred W. Woodhead, Caterham, all of United Kingdom

[73] Assignee: U.S. Philips Corporation, New York, N.Y.

[21] Appl. No.: 850,441

[22] Filed: Apr. 9, 1986

Related U.S. Application Data

[63] Continuation of Ser. No. 437,583, Oct. 29, 1982, abandoned.

[30] Foreign Application Priority Data

Nov. 9, 1981 [GB] United Kingdom ..... 8133688

[51] Int. Cl.[4] ..... H01J 29/70

[52] U.S. Cl. ..... 315/366; 313/422

[58] Field of Search ..... 315/366; 313/422, 105 R, 313/105 CM

[56] References Cited

U.S. PATENT DOCUMENTS

| | | | |
|---|---|---|---|
| 3,854,066 | 12/1974 | Payne | 313/105 CM |
| 3,904,923 | 9/1975 | Schwartz | 313/103 |
| 4,031,552 | 6/1977 | Bosserman et al. | 317/105 CM |
| 4,117,368 | 9/1978 | Marlowe et al. | 315/366 |

FOREIGN PATENT DOCUMENTS

| | | | |
|---|---|---|---|
| 0136443 | 10/1980 | Japan | 313/422 |

*Primary Examiner*—Thomas H. Tarcza
*Assistant Examiner*—Gregory C. Issing
*Attorney, Agent, or Firm*—Robert J. Kraus

[57] ABSTRACT

In order to prevent the walls of the envelope (10) of a flat panel display tube having a large area screen from imploding, supporting walls (22) are provided to divide the interior of the envelope into a plurality of modules. Each module has its own electron beam generating means (24) for producing a low voltage, low current, intensity modulated electron beam (26) which is directed vertically upwards. A laminated channel plate electron multiplier (28) is disposed across the module and extends substantially parallel to the front and rear walls (12, 14) of the envelope. A single column of channels in the electron multiplier (28) is illustrated. The spacing of the channels determines the vertical resolution of the image produced. In order to deflect the electron beam (26) into a particular channel, a plurality of deflector electrodes (30) are disposed on the rear wall (14). These electrodes (30) and the input dynode of the electron multiplier (28) are generally held at the same potential to define a field-free space. However, in order to deflect the electron beam (26), the potential applied to electrodes (30) ahead of the deflection point is reduced so that the beam is deflected towards the selected channel in the electron multiplier (28). The current-multiplied electron beam from the output of the electron multiplier (28) undergoes focusing, horizontal deflection and post deflection acceleration as a result of suitable voltages applied to electrodes provided on the supporting walls (22). These electrodes may be parallel to each other or may diverge in a direction towards the front wall (12).

12 Claims, 3 Drawing Sheets

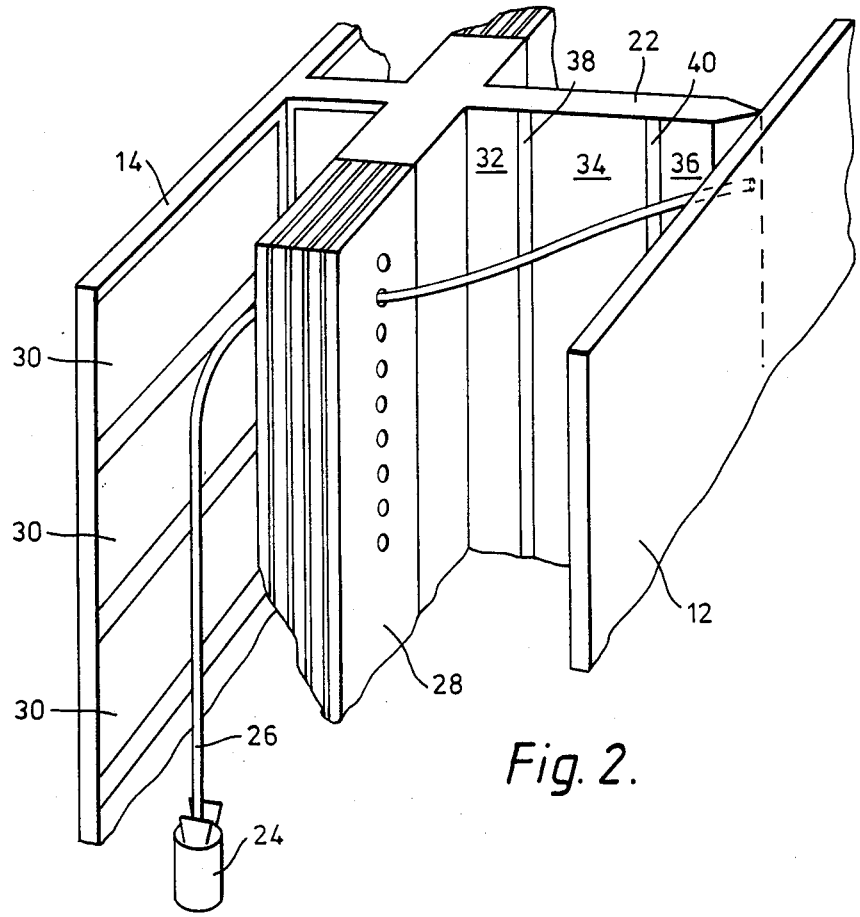
Fig. 2.
Fig. 3.
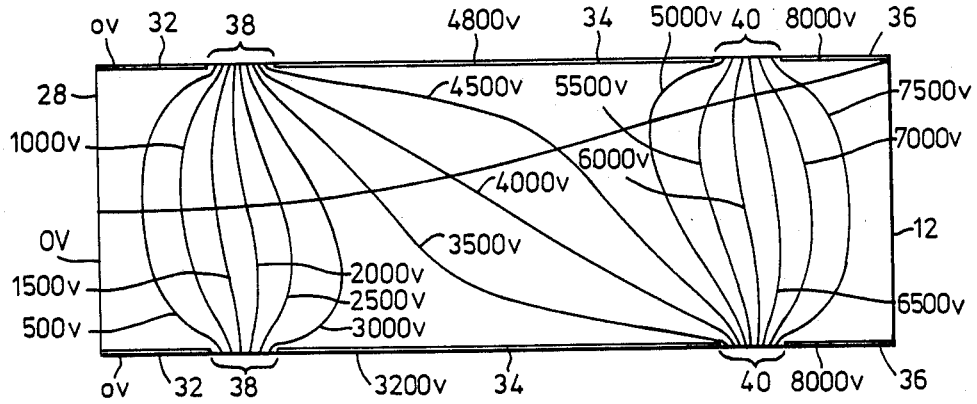

DISPLAY TUBE

This is a continuation of application Ser. No. 437,583, filed Oct. 29, 1982, now abandoned.

BACKGROUND OF THE INVENTION

The present invention relates to a display tube and particularly, but not exclusively, to a large screen area, typically 0.75 to 1 $M^2$, flat panel display tube employing cathodoluminescence.

Problems with large screen area display tubes of the conventional design are their large depth, large weight and high power consumption. One attempt to resolve these problems is disclosed in an article entitled "Large-screen flat-panel television": A new approach, by T.L. Credelle in R.C.A. Engineer, 26-7, July/August 1981, pages 75 to 81, and in British Patent Specification No. 2,005,070A. In order to reduce weight, Credelle divides the interior of the tube envelope into a plurality of horizontally adjacent modules using vertical support walls which contact the inside of the faceplate or front wall and provide a support for the faceplate glass. In consequence the faceplate can be of a thickness, typically 6 mm, which is substantially thinner than for a conventional cathode ray tube faceplate—such as a 25 inch (62.5 cm) kinescope faceplate which is approximately 12 mm thick. As far as power consumption is concerned, Credelle's goal is to limit it to four times that of a conventional tube having a quarter of the screen area.

In the modular tube mentioned above, each module has means for producing three high current, low voltage electron beams which are directed vertically upwards along paths which are parallel to the rear wall of the rectangular, flat panel envelope. Because of the possibility of the beam blowing-up due to space charge effects and because of the need to deflect the electron beams forward towards the screen, a ladder beam guide is provided adjacent to, but spaced from, the rear wall, and additionally vertically spaced-apart, horizontally elongate electrodes are provided on the rear wall; there being one electrode for each space in the ladder beam guide. The ladder beam guide serves to refocus the electron beams at intervals corresponding to every one or two picture elements in the vertical direction to prevent them blowing-up and, in conjunction with the horizontally elongate electrodes, deflects the beams from their vertical paths in the frame direction. Substantially planar, apertured focussing and accelerating grids are arranged parallel to the ladder beam guide to focus and accelerate the deflected beam towards a shadow mask positioned in front of the screen. Coverging and line scanning electrodes are provided on the support walls defining the lateral boundaries of the module to converge the beams on the shadow mask whilst it undergoes line scanning.

A disadvantage of this display tube is the need for high current, low voltage electron beams, because there is no provision to amplify the beam current. Consequently, means such as case the ladder beam guide must be provided to stop the beams from blowing-up. The ladder beam guide comprises a mechanically fragile, precision made mesh-like stucture which is expensive to make because of the close tolerances required to maintain beam focus.

SUMMARY OF THE INVENTION

Objects of the present invention are to avoid having to provide a complex structure to refocus the electron beams every one or two picture elements in the vertical direction and to reduce the number of electrodes required to deflect the electron beam in the frame direction.

According to the present invention there is provided a display tube comprising an evacuated envelope having substantially flat, parallel spaced-apart front and rear walls and a plurality of support means dividing the interior of the envelope into a plurality of modules extending between the front and rear walls for substantially the full height of the envelope, and a cathodoluminescent screen on the interior of the front wall. Each module comprises an electron-beam-producing means arranged to produce and direct an electron beam along a first path substantially parallel to the rear wall, first deflection means for deflecting the electron beam from the first path into one of a plurality of second paths extending towards the screen, a channel plate electron multiplier extending transverse to the second paths, and second deflection means for causing the electron beam to scan in a direction transverse to the first and/or second paths.

By providing an electron multiplier in each module it is possible to use a low voltage, low current beam to effect frame scanning. This means that the beam current can be kept sufficiently low to avoid the effects of space charge blow-up of the electron beam. Also low voltages can be used by the first deflection means. Thereafter the electron beam is amplified by the electron multiplier to provide a high current beam which is accelerated towards the screen by high voltages applied via electrodes on the support means defining the margins of the module.

The second deflection means, which provide line scanning, may be disposed between the electron multiplier and the screen. In a first embodiment the second deflection means comprise pairs of parallel electrodes extending substantially perpendicular to the screen and in a second embodiment the second deflection means comprise pairs of electrodes which diverge towards the screen. The second embodiment provides the possibility for lower second deflection voltages compared with the first embodiment.

It is possible for the second deflection means to precede the first deflection means so that the beam which is incident on the electron multiplier has been addressed both in line and frame directions. In such a case, the electron multiplier comprises a matrix of channels occupying the entire width of the module, the lateral support means of which are substantially perpendicular to the front wall.

If desired, the electron beam in each module may be refocused at a few intervals as it passes along its first path. Refocusing of the electron beam may be necessary because of the very high ratio of throw distances of the electron beam when at the top and bottom of the field scan and because there may be a small amount of defocusing due to space charge.

In order to facilitate the addressing of the beam in the line scanning direction, beam indexing means may be provided for sensing the electron beam when in the vicinity of corner(s) formed by the support means and the screen.

BRIEF DESCRIPTION OF THE DRAWING

The present invention will now be described, by way of example, with reference to the accompanying drawing, wherein:

In FIG. 1, which is not to scale, the depth of the tube has been shown greatly enlarged for the purposes of clarity.

FIG. 2 is a diagrammatic view of a portion of the internal structure of one embodiment of the display tube in accordance with the present invention.

FIG. 3 is a computer plot showing the equipotential lines and the trajectory of the current-multiplied electron beam towards a corner of a module of the type represented by the first embodiment.

DESCRIPTION OF THE PREFERRED EMBODIMENTS

Figure 1:
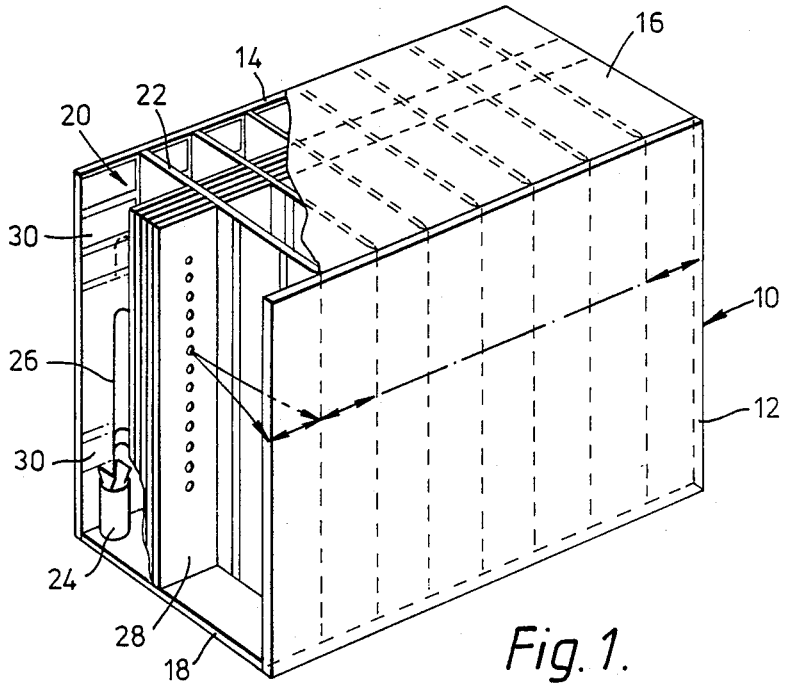
FIG. 1 is a perspective view, partly broken away, of a display tube made in accordance with the present invention.

Referring to FIG. 1, the display tube comprises an envelope 10 formed by an optically transparent front wall 12, a rear wall 14, top and bottom walls 16, 18 and side walls which are not visible in the drawing. The interior of the envelope 10 is divided into a plurality of modules 20 by supporting walls 22 of an electrically insulating material which contact the front and rear walls 12, 14 and help prevent them from imploding under the pressure of air, which is considerable for an evacuated envelope having a front wall area of the order of 1 $m^2$.

An electron beam source 24 is disposed in each module so as to direct a low current, low voltage electron beam 26 upwards along a first path. The electron beam is intensity-modulated at the source 24. A laminated dynode channel electron multiplier 28 is disposed in each module at a point nearer the rear wall 14 than the front wall 12. In the illustrated embodiment the electron multiplier comprises a single column of channels, the vertical spacing between the channels being determined by the required resolution in the displayed image. The details of the fabrication of the electron multiplier 28 will not be given here because they are disclosed in detail elsewhere such as in published British Patent Specifications No. 1,401,969, 1,434,053 and 2,023,332A. However, for those not familiar with this type of electron multiplier, it comprises a stack of spaced-apart, barrel-shape apertured mild steel sheets held at progressively higher voltages. The apertures in the plates are aligned to form channels and contain a secondary emitting material. An electron striking the wall of an aperture in a first dynode produces a number of secondary electrons, each of which on impacting with the wall of an aperture in a second dynode produces more secondary electrons, and so on. The stream of electrons leaving the final dynode is accelerated towards the screen by an accelerating field established between the output of the electron multiplier 28 and a post deflection acceleration electrode (not shown) on the screen.

In order to deflect the electron beam from its first path into a selected channel in the electron multiplier 28, a plurality of vertically spaced, horizontally elongate electrodes 30 are provided on or carried by the rear wall 14. The height of the electrodes 30 is of the same order as the spacing between the rear wall 14 and the input face of the electron multiplier 28. By maintaining the electrodes 30 and the input dynode of the electron multiplier 28 at the same voltage, say that of the final electrode of the electron beam source 24, then the electron beam 26 follows the first path through a field-free space. However, in order to deflect the electron beam 26 into a selected channel of the electron multiplier 28, then at least one electrode 30, if not several electrodes 30, ahead of the electron beam have their voltages reduced to zero at a rate such that the beam is deflected forwards into the selected channel. Because of the presence of the electron multiplier 28 the input beam and its addressing are effectively isolated from the amplified output beam, which means that each beam can be optimised for its intended purpose.

By means of electrodes applied to the supporting walls 22 the amplified output electron beam executes a line scan over the width of its module as indicated by the double-headed arrows. For a normal television picture in the United Kingdom, the scan time for a whole raster line including flyback is typically 64 $\mu$S and accordingly by parallel addressing of the modules each output electron beam has 64 $\mu$S to scan the screen across its modular width and flyback. These electrodes may be applied to the supporting walls 22 by evaporation, screen printing or sputtering.

By way of example, the front wall of the envelope measures 1300 mm (long) by 700 mm (high) and the interior depth of the envelope is of the order of 105 to 110 mm. The depth comprises 30 mm between the rear wall 14 and the input face of the electron multiplier 28, 70 mm between the output surface of the electron multiplier 28 and the front wall, and the remainder of the depth comprises the thickness of the electron multiplier 28 which, in this example, is formed by five dynodes. The module pitch is 25 mm. The pitch of the electrodes 30 is 20 mm with a space of 2 mm between each. Accordingly there are between thirty-two and thirty-five electrodes 30. The vertical pitch of the channels in the electron multiplier 28 is, in this example, between 1 and 1.5 mm, which defines the vertical resolution of the image to be displayed. Typical voltages are: +500 V for the output of the electron beam source, the input to the electron multiplier and the electrodes 30; 300 to 500 V per stage of the electron multiplier; and 8 kV between the electron multiplier and the screen.

Referring to FIGS. 2 and 3, three sets of conductive electrodes 32, 34 and 36 are applied, for example by evaporation, to the supporting walls 22 which themselves are of an electrically insulating material such as glass or ceramic. Between each electrode there may be resistive stripes across each of which there is a progressive potential drop so that an electron lens is formed with its opposite stripe. The conductive electrodes 32 are held at the output voltage of the electron multiplier 28 which in FIG. 3 is denoted by 0 V, all the subsequent voltages referred to in FIG. 3 are referenced to the electrodes 32. The electrodes 36 are at 8 kV to provide the necessary accelerating field for the electron beam. The electrodes 34 are used for line scanning and accordingly the voltage applied to each is varied as required about a means of 4 kV. In order to bring about a deflection to one corner of the screen, a deflection voltage of 1.6 kV is necessary so that one of the electrodes 34 is at 3.2 kV and the other is at 4.8 kV.

In order to minimise the risk of undesired vertical bars in the displayed image at the junction between the modules, the supporting wall is tapered as shown in FIG. 2 and also the two electron lenses are designed so that the electron beam can reach the corner.

Figure 4:
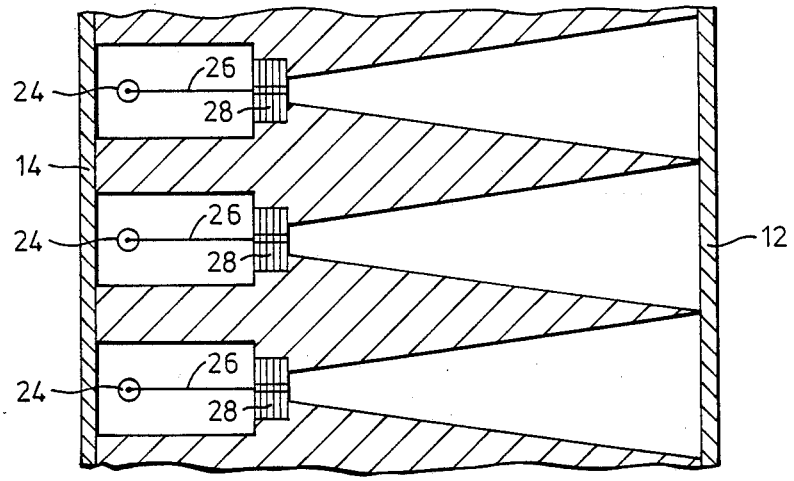
FIG. 4 is a diagrammatic horizontal cross-sectional view of the internal structure of a second embodiment of the display tube made in accordance with the present invention.
Figure 5:
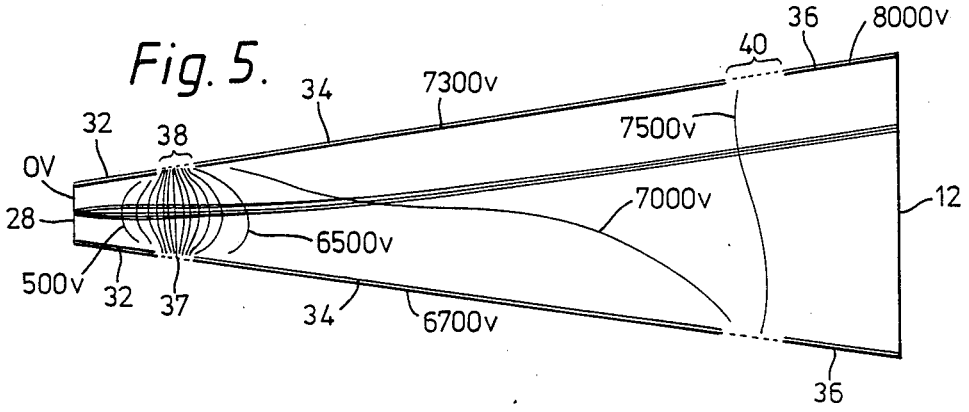
FIG. 5 is a computer plot of the equipotential lines and an electron beam trajectory which occurs in an embodiment of a display tube having divergent electrodes.

Referring to the embodiment shown in FIG. 4 and 5 in which corresponding reference numerals have been used to identify the same components as in the embodiment of FIGS. 1 to 3, the main difference between them is that the supporting walls 22 supporting the electrodes 32, 34, 36 and the resistive stripes 38, 40 diverge relative to each other. This arrangement has the advantages that lower deflection voltages are necessary to scan the width of the module and it is possible to obtain a strong focusing electron lens 37 near the output of the electron multiplier 28. This lens 37 can be used in conjunction with the electron lens which normally exists at the electron multiplier 28 output to obtain a well-focused spot on the screen. In FIG. 5 the equipotential lines represent steps of 500 V but because of their closeness to each other it is not possible to reference each one with its voltage.

Figure 6:
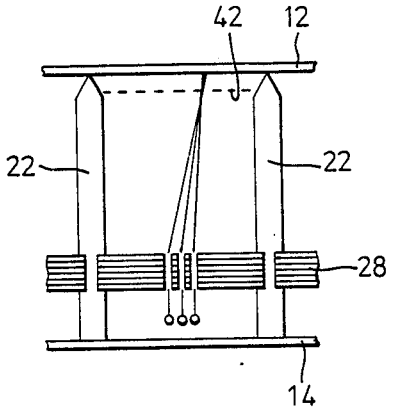
FIG. 6 is a sketch of a cross-section of a portion of a display tube in which, in each module, three electron beams are produced, current-multiplied and focused onto a shadow mask.

FIG. 6 shows diagrammatically an embodiment of a display tube for producing coloured images. In this embodiment three parallel low current, low voltage electron beams are produced by separate electron guns or an integrated electron gun structure, which electron beams are current-multiplied in the electron multiplier 28 which has three columns of laterally-aligned apertures. The amplified beams are converged towards apertures in a shadow mask 42 whilst simultaneously undergoing line scanning. The screen applied to the front wall comprises triads of phosphor dots or repeating groups of phosphor stripes as is well known.

Figure 7:
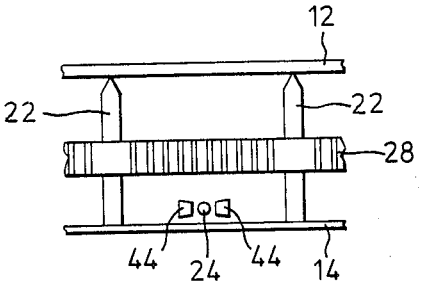
FIG. 7 is a sketch of a cross-section of a portion of a display tube in which the electron beam undergoes line and frame deflection prior to undergoing current multiplication.

FIG. 7 shows an embodiment in which both frame and line scanning is carried out prior to the electron beam undergoing amplification. Line deflection may be carried out using divergent plates 44 disposed downstream of the electron beam source 24. In this embodiment since the electron beam is addressed in two dimensions, the electron multiplier 28 comprises a matrix of channels extending over the entire width of the module. Additionally the screen, and thus the front wall 12, can be brought close, for example within 10 mm, to the output surface of the electron multiplier 28.

Figure 8:
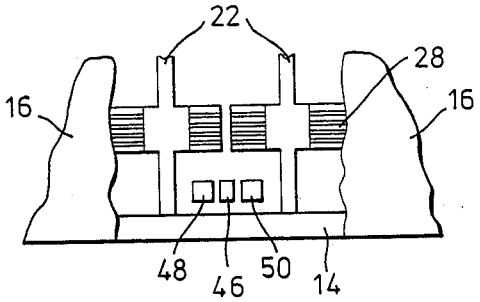
FIG. 8 is a sketch plan view of a part of the top of a display tube with a portion broken away showing means for assisting in the centring of an electron beam in its module.

FIG. 8 shows a view from above of the interior of a module. In order to centre the electron beam dynamically when in its first path, three sensing electrodes 46, 48, 50 are provided on the top wall 16 above the electron beam source. If the undeflected beam is central then this will be detected by the electrode 46. However if it is off-centre then it will be detected by one of the electrodes 48, 50 so that a correction voltage can be applied to the electron beam source, which is equipped with electrostatic beam deflecting plates.

Figure 9:
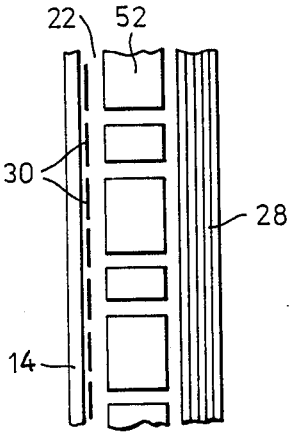
FIG. 9 is an elevational sectional view through a module showing an arrangement of electrodes for refocusing an electron beam.

FIG. 9 shows an electrode arrangement 52 which can be applied to the supporting walls 22 of each module to refocus the electron beam in the line direction prior to deflecting it towards the input dynode of the electron multiplier 28. Refocusing of the beam may be necessary because of the very high ratio of throw distances of the electron beam when at the top and bottom of the field scan and because there may be a small amount of defocusing due to space charge. The number of electrodes in the arrangement 52 is far less than the number of picture elements in the vertical direction. Generally, the electrodes of the arrangement 52 are maintained at a steady voltage to provide a field-free space for the electron beam. However, the potential applied to the electrodes approximately 100 mm ahead of the point of deflection of the electron beam is lowered so that the electron beam is refocused in the line direction. In the frame direction the deflection itself provides good focusing of the beam. In consequence, the shape of the electron beam incident on the input dynode is better suited for entering the channel for multiplication.

If it is desired to use beam indexing, the position of the amplified electron beam can be detected by disposing an electrode (not shown) at one or both corners of the module where the supporting walls 22 meet the front wall 12.

By comparing FIGS. 2, 4 and 6 with FIG. 7, it will be noted that there are two approaches in constructing the interior of the tube. In FIGS. 2, 4 and 6 the supporting walls 22 extend from the front to the rear walls and the electron multipliers are of modular construction. By way of comparison, the embodiment shown in FIG. 7 comprises an electron multiplier which is continuous across the width of the envelope and supporting walls which are in two parts. The precise construction selected depends on a number of factors, for example the number of electrical connections and the ease of manufacture of the electron multiplier. The modular electron multiplier 28 of FIGS. 2, 4 and 6 is easier to fabricate but separate electrical connections are necessary to each electron multiplier. In contrast a single large area electron multiplier is technically more difficult to make but requires fewer electrical connections.

We claim:

1. A flat panel display tube comprising an evacuated envelope having substantially flat, parallel, spaced-apart front and rear walls and a plurality of support members extending between the front and rear walls for substantially the full height of the envelope, said support members dividing the interior of the envelope into a plurality of modules, said front wall comprising a glass faceplate supporting a luminescent screen on an interior surface thereof;

characterized in that each module includes an arrangement for minimizing divergence of an electron beam propagating therein, comprising:

(a) means for producing a low current electron beam, said means being arranged to direct said electron beam along a first path substantially parallel to the rear wall;

(b) first deflection means in the rear of the envelope for deflecting the electron beam from the first path into one of a plurality of substantially parallel second paths extending toward the screen;

(c) second deflection means disposed along one of said first and second paths to effect scanning of the beam transverse to said path; and (d) a channel plate electron multiplier extending transversely to the second path and includig a multiplicity of electron-multiplying channels, each disposed to receive electrons from the low current electron beam as it travels along a respective one of the second paths, and to produce a high current electron beam traveling along the second path toward the screen.

2. A flat panel display tube comprising an evacuated envelope having substantially flat, parallel, spaced-apart front and rear walls and a plurality of support members extending between the front and rear walls for substantially the full height of the envelope, said support members dividing the interior of the envelope into a plurality of modules, said front wall comprising a glass faceplate supporting a luminescent screen on an interior surface thereof;

characterized in that each module includes an arrangement for minimizing divergence of an electron beam propagating therein, comprising:

(a) means for producing a low current electron beam, said means being arranged to direct said electron beam along a first path substantially parallel to the rear wall;

(b) first deflection means in the rear of the envelope for deflecting the electron beam from the first path into one of a plurality of substantially parallel second paths extending toward the screen;

(c) a channel plate electron multiplier extending transversely to the second path and including a multiplicity of electron-multiplying channels, each disposed to receive electrons from the low current electron beam as it travels along a respective one of the second paths, and to produce a high current electron beam traveling toward the screen; and (d) second deflection means disposed between the electron multiplier and the screen to effect scanning of the high current electron beam transverse to the second path.

3. A flat panel display tube as in claim 2 where the second deflection means comprises a pair of parallel electrodes extending in the direction from the electron multiplier to the screen.

4. A flat panel display tube as in claim 2 where the second deflection means comprises a pair of diverging electrodes extending in the direction from the electron multiplier to the screen.

5. A flat panel display tube as in claim 1, 2, 3 or 4 where the first deflection means comprises a plurality of parallel, spaced-apart electrodes extending transversely to said first path.

6. A flat panel display tube as in claim 5 where the electrodes forming the first deflection means are disposed on the rear wall.

7. A flat panel display tube as in claim 1, 2, 3 or 4 where each of the modules contains a single one of the means for producing a low current electron beam, and where the electron multiplier channels in each module are arranged in a single column extending along the first path.

8. A flat panel display tube as in claim 7 including means disposed in each module for centering the respective electron beam as it travels along the first path.

9. A flat panel display tube as in claim 1, 2, 3 or 4 where each module contains three of the means for producing a low current electron beam, and where the electron multiplier channels in each module are arranged in three parallel columns, each extending along the first path for a respective one of the beams, and where a shadow mask is disposed adjacent to the screen.

10. A flat panel display tube as in claim 1, 2, 3 or 4 including means disposed along the first path for periodically refocusing the low current electron beam.

11. A flat panel display tube as in claim 1, 2, 3 or 4 including beam indexing means, disposed in the vicinity of the screen where each support member meets the front wall, for sensing the deflection of the electron beam to this vicinity.

12. A flat panel display tube comprising an evacuated envelope having substantially flat, parallel, spaced-apart front and rear walls and a plurality of support members extending between the front and rear walls for substantially the full height of the envelope, said support members dividing the interior of the envelope into a plurality of modules, said front wall comprising a glass faceplate supporting a luminescent screen on an interior surface thereof;

characterized in that each module includes an arrangement for minimizing divergence of an electron beam propagating therein, comprising:

(a) means for producing a low current electron beam, said means being arranged to direct said electron beam along a first path substantially parallel to the rear wall;

(b) a channel plate electron multiplier extending substantially parallel to the first path and including a matrix of electron multiplying channels arranged in rows and columns, each channel being adapted to receive electrons from a low current electron beam, and to produce a high current electron beam traveling toward the screen;

(c) first deflection means in the rear of the envelope for selectively deflecting the electron beam from the first path into one of a plurality of substantially parallel second paths to a selected one of the rows of electron multiplier channels; and (d) second deflection means in the rear of the envelope for selectively deflecting the electron beam from one of the first and second paths to a selected one of the columns of electron multiplier channels.

* * * * *